United States Patent [19]

Thorsell

[11] 4,448,004

[45] May 15, 1984

[54] CHANNEL AND CUT-OUT STRUCTURE FOR REMOVEABLE PARTITION WALL

[75] Inventor: Stanley E. Thorsell, Edmonton, Canada

[73] Assignees: Robert S. Agar Inc., Markham; Thorsell Holdings Ltd., Edmonton; Mudlake Holdings Ltd., Calgary, all of Canada

[21] Appl. No.: 286,848

[22] Filed: Jul. 27, 1981

[51] Int. Cl.[3] ..... E04H 1/00

[52] U.S. Cl. ..... 52/241; 52/481; 52/667

[58] Field of Search ..... 52/486, 511, 238, 241, 52/667, 698, 481; 403/347, 346

[56] References Cited

U.S. PATENT DOCUMENTS 3,621,635 11/1971 Lange ..... 52/486

4,128,979 12/1978 Price ..... 52/241

*Primary Examiner*—John E. Murtagh

*Assistant Examiner*—Michael Safavi

*Attorney, Agent, or Firm*—Ernest Peter Johnson

[57] ABSTRACT

An improvement is provided in a removeable partition wall system wherein gypsum board panels, having suspension assemblies attached thereto, are suspended from horizontal channel support members extending through cut-outs formed in the webs of vertical channel stud members. The support members are preferably V-shaped or semi-circularly shaped. The cut-out comprises upper and lower portions. The upper portion is sized to permit the support member to be inserted therethrough on edge. The lower portion forms a seat dimensioned and shaped to conform with the outline of the support member. The cut-out is formed to provide locking shoulders, at the confluence of the upper and lower portions, which function to hold the support member (when seated) against rotation or vertical displacement.

2 Claims, 5 Drawing Figures

CHANNEL AND CUT-OUT STRUCTURE FOR REMOVEABLE PARTITION WALL

BACKGROUND OF THE INVENTION

The present invention relates to an improvement in a removeable partition wall. More particularly, it relates to the support framework, forming the core of the wall, from which gypsum board panels may be suspended.

Removeable partition walls are now widely used in office buildings and the like.

One such wall is disclosed in Canadian Pat. Nos. 1,002,279 and 1,044,870. In this particular wall, illustrated in the Prior Art Figures annexed hereto, a support framework is provided which includes channel-like runners a, b mounted on the floor and ceiling respectively. Extending between these runners are laterally spaced, vertical stud channel members c. Horizontally aligned cut-outs d are formed in the webs e of the stud channel members, through which horizontal channel support members f are extended. Gypsum board panels g are suspended from the horizontal channel support members by suspension assemblies h affixed to the rear faces of the panels.

As shown, the prior art horizontal support members and vertical stud members are generally C-shaped channel members. Each cut-out in a vertical stud member is generally rectangular in configuration and forms horizontal support shoulders i at the base thereof.

To insert a horizontal support member through the aligned cut-outs the member is turned on its side edge, slid through the cut-outs, and then rotated so that the C-channel opens upwardly and its base j seats on support shoulders i. Since, for support purposes, a tight fit exists between the support member and the edges of the cut-out, a strong twist must be given to the member to rotate it into place. This is a somewhat difficult maneuver for the installer and can result in damage to the support member.

When the wall is being assembled, the first gypsum panel is suspended from one upwardly projecting side leg of the horizontal C-shaped support member. There is a tendency for the support member to rotate when loaded on one side in this manner. To overcome this, a stud spacer (not shown) is used to lock the horizontal support member against rotation and to provide stiffening to the vertical stud member. The stud spacer is relatively expensive and its installation complicates the assembly of the wall.

SUMMARY OF THE INVENTION

The present invention provides an improvement in a removeable partition wall of the type previously described. More particularly, each cut-out is formed with upper and lower portions. The upper portion is generally rectangular in configuration and sized to permit the support member to be inserted therethrough when on edge. The lower portion is generally V-shaped in configuration and dimensioned to correspond or conform with the outer outline of the support member. The stud member web forming the cut-out has a pair of opposed, inwardly projecting shoulders positioned at the confluence of the upper and lower cut-out portions. These shoulders function to lock the support member against the seat created by the web edge defining the lower portion of the cut-out.

When assembling the wall, the horizontal support member is inserted on edge through the upper portions of an aligned array of cut-outs. It is then dropped while still on edge into the cut-out lower portions. Here it is rotated to lock one side leg of the support member under one web shoulder and then rotated further to snap the other side leg under the other shoulder, whereby the support member is thus locked against the web seat and resists further rotation or vertical displacement.

In a preferred feature, the support member, and thus the web seat, is generally V-shaped.

In another preferred feature, each of the two side legs of the C-shaped vertical stud member has an inwardly projecting flange. These flanges are so dimensioned that they closely bracket and support the support member when the latter is seated.

These modifications give the following advantages:

1. The support member may be easily seated by a twisting and snapping action which is less arduous and damaging than that previously practised.

2. The abutment of the stud member flanges and the support members results in the stud member being comparatively rigidly boxed. This assures that at the panel joints the adjacent panel edges remain in alignment.

3. The locking shoulders prevent the seated support member from twisting when loaded on one side.

4. In connection with the C-shaped support member, the clips 1 of the suspension assemblies tended to ride on the side edges the support member side legs—this made sideways movement of the panels difficult. The preferred V-shaped support member provides an inclined side leg surface for engaging the inclined clip of the suspension assembly—as a result, the weight of the panel is distributed over the side leg surface, thereby facilitating sideways movement of the panels.

DESCRIPTION OF THE DRAWINGS

FIGS. 1 and 2 illustrate the prior art partition wall in which:

FIG. 1 is a perspective view of the support structure showing the C-shaped horizontal and vertical members together with the rectangular shaped cut-out;

FIG. 2 is a side view of the partition wall system with some of the panels removed to reveal the framework; and FIGS. 3–5 illustrate the improvement of the present invention in which:

FIG. 3 is a perspective view of the support structure of the present invention showing the horizontal support member seated and confined in the cut-out of the vertical stud member;

FIG. 4 is a vertical section of the stud member showing the support member locked in the confines of the cut-out; and FIG. 5 is a view similar to that of FIG. 4 but showing an alternative configuration for the support member.

DESCRIPTION OF THE PREFERRED EMBODIMENT

Figure 3:
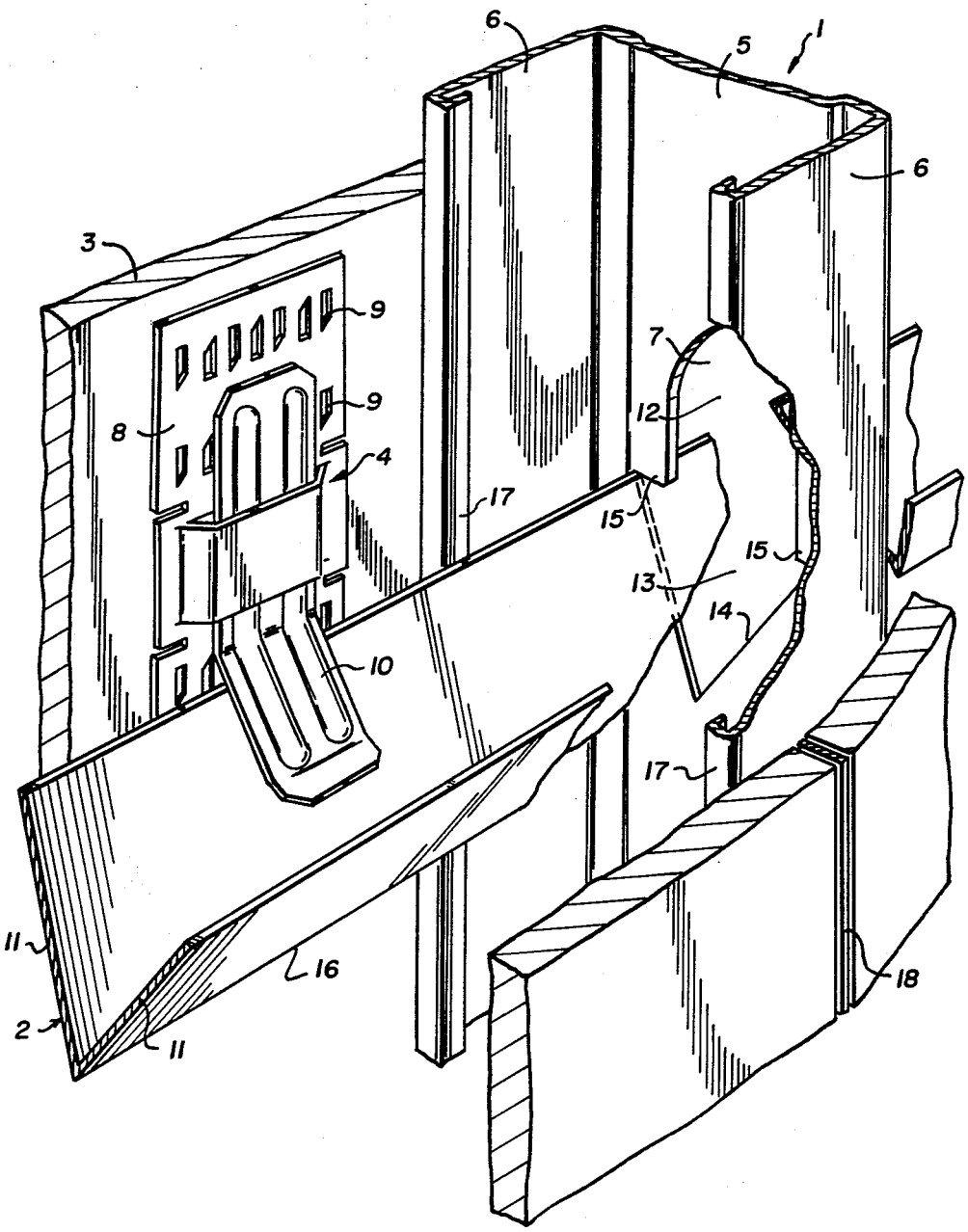

With reference to FIG. 3, a portion of the framework of a removeable partition wall system is shown to include a vertical stud member 1 supporting a horizontal support member 2. A gypsum wall panel 3 is suspended from the support member 2 by means of a plurality of suspension assemblies 4 affixed to the rear face of the panel 3. The stud member 1 is preferably a C-shaped steel channel having a web portion 5, perpendicular to the suspended panel 3, and a pair of spaced side walls 6 parallel to the panel 3. The web portion 5 is formed to provide a cut-out 7 through which the support member 2 is inserted.

Figure 1:
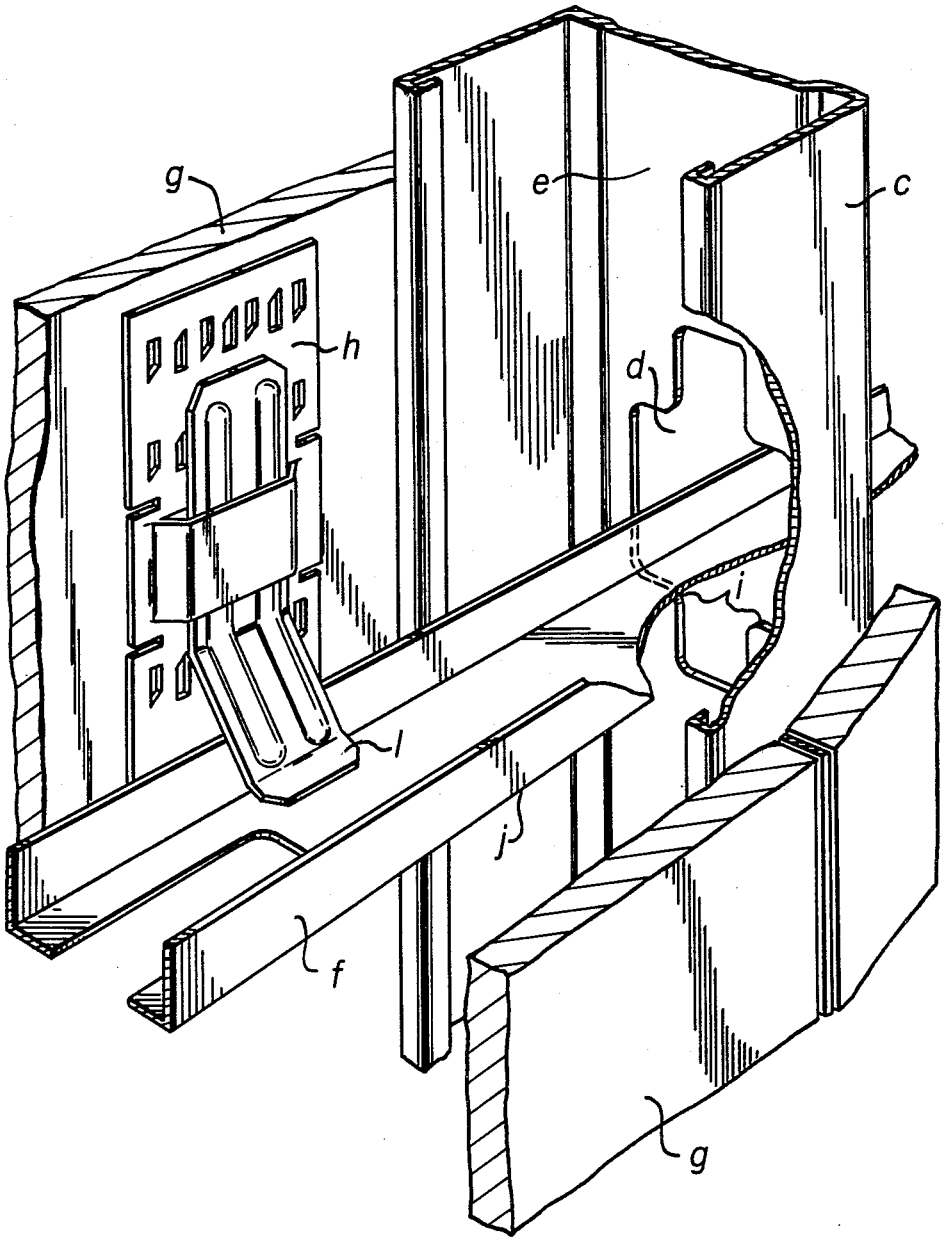
Fig. 1. PRIOR ART
Figure 2:
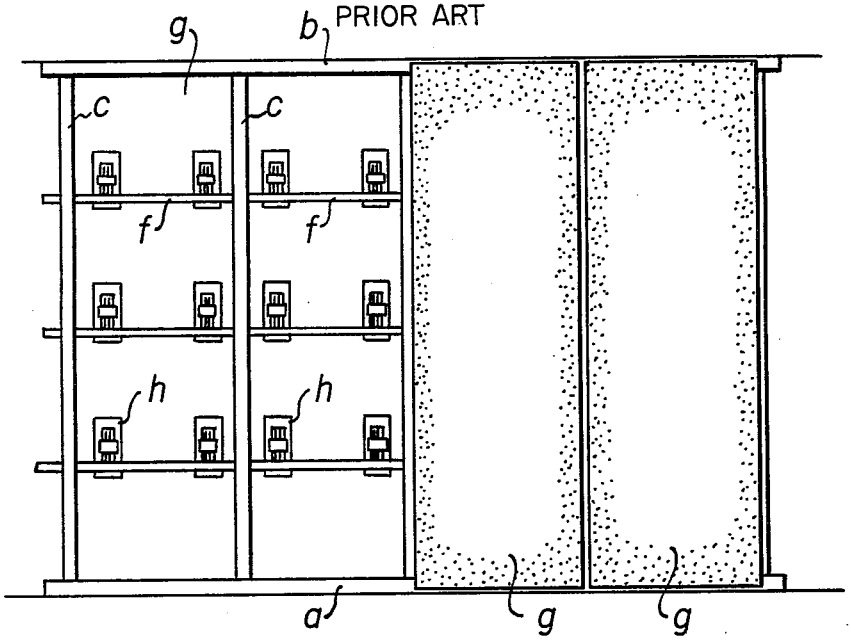
Fig. 2. PRIOR ART
Figure 4:
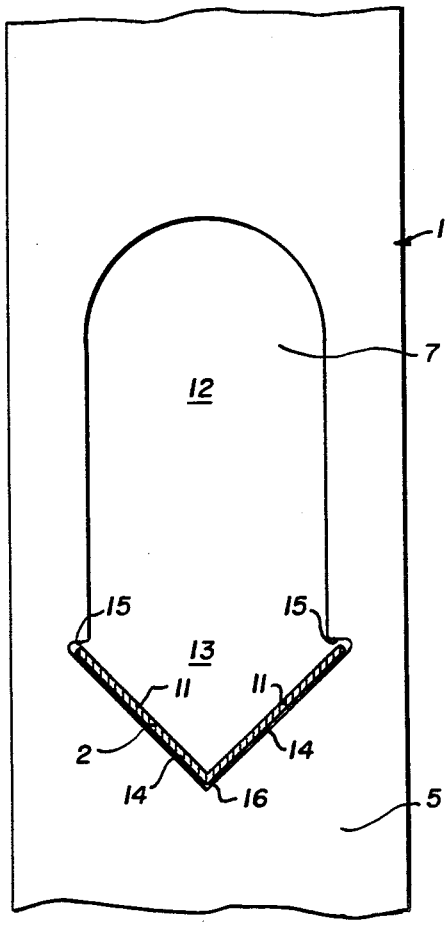
Figure 5:
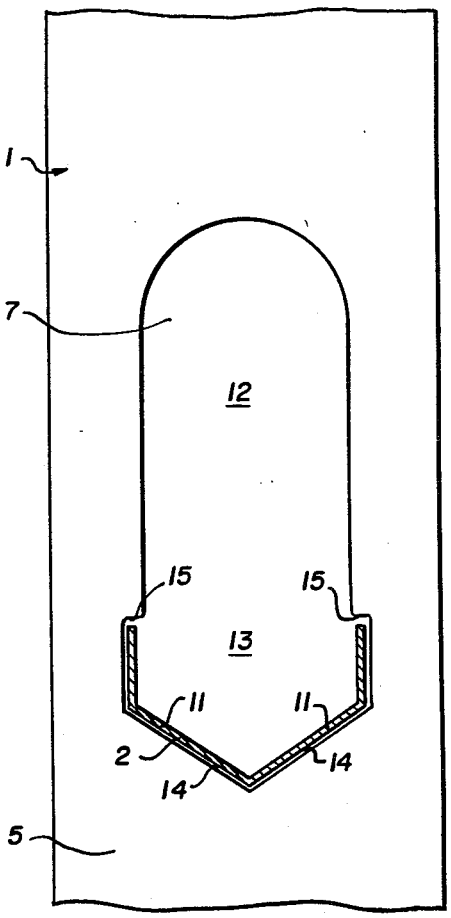

It should be understood that the partition wall system of the present invention is similar in many respects to the prior art system shown in FIG. 2. Thus a plurality of laterally spaced vertical stud members 1 are provided, having one or more rows of horizontally aligned cut-outs 7 formed by the web portions 5 of the stud members 1. The horizontal support members 2 each extend through an array of aligned cut-outs 7 and are supported by the web portions 5 outlining the cut-outs 7.

The suspension assemblies 4 suspending the gypsum board panels 3 are the subject matter of Canadian Pat. No. 1,044,870 and will be only briefly described herein. Each suspension assembly 4 comprises a gang nail plate 8 affixed by tangs 9 driven into the rear face of the panel 3. A removable hanger member in the form of a spring clip 10 is attached to the gang nail plate 8. The lower portion of the clip 10 is inclined rearwardly from the plane of the plate 8, and engages a side leg 11 of the horizontal support member 2, to suspend a panel 3 therefrom.

In accordance with the present invention the cut-outs 7 include an upper portion 12 and a lower portion 13. The upper portion 12 is sized laterally to permit the support member 2 to be extended therethrough when on edge. The web edge outlining the lower portion 13 defines a seat 14 which is dimensioned and preferably shaped to conform with the outer outline of the support member 2. The web 5 of the stud member 1 provides inwardly projecting shoulders 15 at the confluence of the upper and lower cut-out portions 12 and 13, which shoulders 15 serve to lock the support member 2 against the seat 14 to prevent rotation or upward displacement of the support member 2.

As shown in the Figures, the support member 2, and thus the lower portion 13 of the cut-out 7, is preferably V-shaped. These V-shaped channel members or V-channels are formed from a pair of inclined side legs 11 joined at an apex 16. The upper portion 12 is generally semi-circularly shaped, which allows the V-channel 2 to be extended therethrough one edge. To lock the V-channel 2 against the seat 14, it is rotated to lock one side leg 11 under one web shoulder 15. The V-channel 2 is then rotated further to snap the other side leg 11 under the other shoulder 15.

To provide rigidity to the framework, the side walls 6 of the vertical stud members 1 may be provided with inwardly extending stud flanges 17, which abut against the upper edges of the V-channel side legs 11. In this manner, the side walls 6 of the stud member are boxed against inward movement. This helps to ensure that at the panel joints 18 the adjacent panel edges abutting against the stud member 1 remain in alignment.

The support member 2, and thus the lower portion of the cut-out, may assume different shapes for the purpose of the present invention. For example, a support member of semi-circular form could be used. However, the provision of the V-shape provides an inclined side leg surface 11 which engages the inclined portion of the suspension assembly clip 10; this relationship allows the weight of the panel 3 to be advantageously distributed over the side leg surface 11 to facilitate sideways movement of the panels.

While the present invention has been disclosed in connection with the preferred embodiment thereof, it should be understood that it extends to other embodiments which are within the spirit and scope of the appended claims.

The embodiments of the invention in which an exclusive property or privilege is claimed are defined as follows:

1. In a partition wall having a framework comprising spaced vertical stud members having webs forming aligned cut-outs and one or more horizontal support members, having side legs, extending through said cut-outs, said framework supporting a plurality of panels suspended in side-by-side relationship from the support members, the improvement comprising:

the support member being generally V-shaped;

each such cut-out having a generally rectangular upper portion and a generally V-shaped lower portion, whereby the web edge defining the cut-out forms a generally V-shaped seat and inwardly projecting shoulders at the confluence of said portions;

the seat being dimensioned and shaped so as to conform with the outer surface of the support member;

the upper portion being of a size sufficient to permit translation therethrough of the support member on edge;

whereby, when the support member is extended on edge through the upper portions of an array of cut-outs, it may be dropped on edge into the corresponding lower portions and rotated to lock one side leg of the support member under one shoulder and further rotated to snap the other side leg under the other shoulder, whereby the support member is then locked against rotation or vertical displacement.

2. The improvement as set forth in claim 1 wherein:

the stud member is generally C-shaped, having a web and side legs, each side leg having an inwardly projecting flange remote from the web, which flanges are dimensioned so that the support member, when seated, is closely bracketed and supported by said flanges.

* * * * *